US008596086B2

(12) United States Patent
Kim

(10) Patent No.: US 8,596,086 B2
(45) Date of Patent: Dec. 3, 2013

(54) REFRIGERATOR AND CONTROL METHOD THEREOF

(75) Inventor: Seong Wook Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 1028 days.

(21) Appl. No.: 12/634,412

(22) Filed: Dec. 9, 2009

(65) Prior Publication Data

US 2010/0175415 A1 Jul. 15, 2010

Related U.S. Application Data

(60) Provisional application No. 61/145,002, filed on Jan. 15, 2009.

(51) Int. Cl.
*F25D 3/00* (2006.01)

(52) U.S. Cl.
USPC ..... 62/389; 62/440

(58) Field of Classification Search
USPC ..... 62/389, 377, 440; 222/146.6, 537
See application file for complete search history.

(56) References Cited

U.S. PATENT DOCUMENTS

| | | | | |
|---|---|---|---|---|
| 5,333,660 | A * | 8/1994 | Kohlmann et al. | 141/263 |
| 5,766,453 | A * | 6/1998 | Morellato et al. | 210/143 |
| 7,137,272 | B2 * | 11/2006 | Park et al. | 62/389 |
| 7,455,085 | B2 * | 11/2008 | Voglewede et al. | 141/360 |
| 7,766,026 | B2 * | 8/2010 | Boey | 137/1 |
| 7,861,644 | B2 * | 1/2011 | Ghassemlou et al. | 99/281 |

* cited by examiner

*Primary Examiner* — Mohammad M Ali
(74) *Attorney, Agent, or Firm* — Birch, Stewart, Kolasch & Birch, LLP

(57) ABSTRACT

Provided is a refrigerator and a control method thereof. In the refrigerator and control method thereof, when hot water is dispensed from a dispenser, a safety tap is withdrawn to prevent splashing of water and enable hot water to be safely dispensed.

11 Claims, 8 Drawing Sheets

REFRIGERATOR AND CONTROL METHOD THEREOF

This Non-Provisional application claims priority under 35 U.S.C. 119(e) on U.S. Provisional Application No. 61/145,002, filed on Jan. 15, 2009, which is hereby incorporated by reference in its entirety.

THE BACKGROUND

1. The Field

The present invention relates to a refrigerator and a control method thereof.

2. Description of the Related Art

In general, a refrigerator is a device for storing food at low temperatures, and is configured to store food in a frozen state or in refrigeration according to food type.

The inside of a refrigerator is cooled by continuously supplied cold air, which is continuously generated through heat exchange of refrigerant in a refrigeration cycle of compression-condensation-expansion-evaporation. Also, cold air supplied into the refrigerator is uniformly distributed throughout the interior of the refrigerator by means of convection so that food inside the refrigerator can be stored at desired temperatures.

A refrigerator body has a hexahedral shape with an open front, and the inside of the body includes a refrigeration compartment and a freezer compartment. A refrigeration compartment door and a freezer compartment door are provided on the front of the body to selectively close the open portion.

Also, a plurality of drawers, shelves, storage boxes, etc. is provided in a storage space within the refrigerator to enable optimal storage of various types of foods. Further, a plurality of baskets is provided on the rear of the refrigeration compartment door or the freezer compartment door. The storage space within the refrigerator is partitioned by the shelves, storage boxes, and baskets to enable proper storage of different types of foods.

Recently, refrigerators are being marketed that are provided with a dispenser on the front of a door to allow users to dispense filtered water or ice without opening the door.

THE DETAILED DESCRIPTION

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
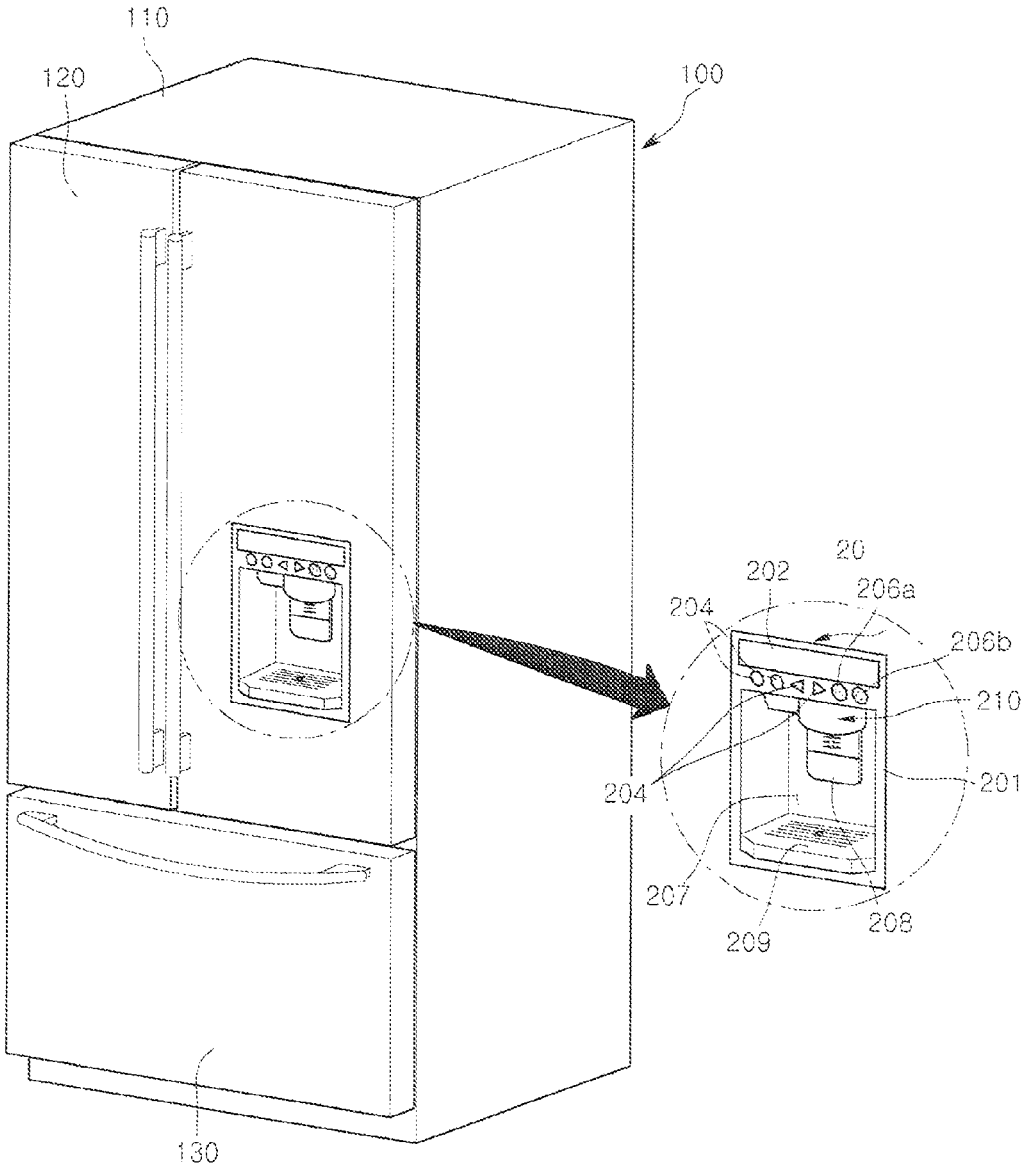
FIG. 1 is perspective view showing the exterior of a refrigerator according to a first embodiment of the present invention.

FIG. 1 is perspective view showing the exterior of a refrigerator according to a first embodiment of the present invention.

A 3-door bottom freezer refrigerator will be exemplarily used to describe the present invention below. However, the spirit and scope of the present invention are not limited to a 3-door bottom freezer refrigerator such as that illustrated in FIG. 1, and can be applied to all types of refrigerators, including a top mount refrigerator with the freezer compartment at the top, and a side-by-side refrigerator with the refrigeration compartment and freezer compartment provided to the left and right of each other.

Referring to FIG. 1, a refrigerator 100 according to embodiments of the present invention is configured with a body 110, a door 120 coupled to be capable of pivoting at the front of the body 110, and a freezer compartment drawer 130 provided to be capable of being slid and withdrawn forward from the body 110. Also, the body 110 defines a storage space of an approximate hexahedral shape with an open front, in which to store foods.

The storage space of in the body 110 is partitioned into an upper portion and lower portion that define a refrigeration compartment and freezer compartment, respectively, and food is stored in the refrigeration compartment or freezer compartment depending on its storage requirements. Also, the temperatures of the refrigeration compartment and freezer compartment are maintained at suitable levels through controlling the amount of cold air that is supplied to the refrigeration compartment and freezer compartment.

The refrigeration compartment defined in the body 110 is selectively closed by the door 120. Also, the freezer compartment is provided below the refrigeration compartment, and the freezer compartment drawer 130 is provided in the freezer compartment to be withdrawn forward and inserted rearward. In detail, the freezer compartment drawer 130 is configured with a freezer box received within the freezer compartment, and a freezer compartment door coupled to the front of the freezer box. A user is able to withdraw the freezer compartment door forward to store or extract food.

A dispenser 20 for supplying water is provided at the front of the door 120. The dispenser 20 is for enabling water filtered within the body 110 to be dispensed outside the refrigerator 100, and has a portion thereof recessed inward into the door 120.

In detail, the dispenser 20 includes a housing 201 with at least a portion thereof recessed inward into the door 120, a water dispensing switch 208 for dispensing water, control buttons 204 for controlling the operation of the dispenser 20 or the refrigerator 100, a hot water button **206*a* for selecting hot water and a cold water button 206*b* for selecting cold water, a display 202 for displaying the operating state of the dispenser 20 or the refrigerator 100, and a rotating lever 210 provided with a water outlet 280 (in FIG. 3**) therein.

In further detail, a vessel receiving niche 207 is formed recessed rearward in the housing 201. Also, a tray 209 is detachably provided on the floor of the vessel receiving niche 207 to receive residual water that descends from the water outlet 280 or water that splashes out from a vessel.

In addition, the rotating lever 210 is provided at the top of the vessel receiving niche 207. The rotating lever 210 is configured to withdraw a safety tap 230 (to be described), and a detailed description of its structure and operation will be described below.

Furthermore, the water dispensing switch 208 is provided at the rear wall of the vessel receiving niche 207. The water dispensing switch 208 is configured to be pressed, and may operate to dispense water from the water outlet 280 when a user presses it with a vessel.

The display 202 and the control buttons 204 may be provided at the top of the housing 201 to enable a user to control the operation of the dispenser 20 and the refrigerator 100.

Further, the hot water button 206*a* and the cold water button 206*b* are provided to one side of the control buttons 204.

In detail, when the hot water button 206*a* or the cold water button 206*b* is selected, and the water dispensing switch 208 is pressed, hot water or cold water is dispensed from the water outlet 280. Moreover, the selection of at least one of the hot water button 206*a* and the cold water button 206*b* may be maintained.

Figure 2:
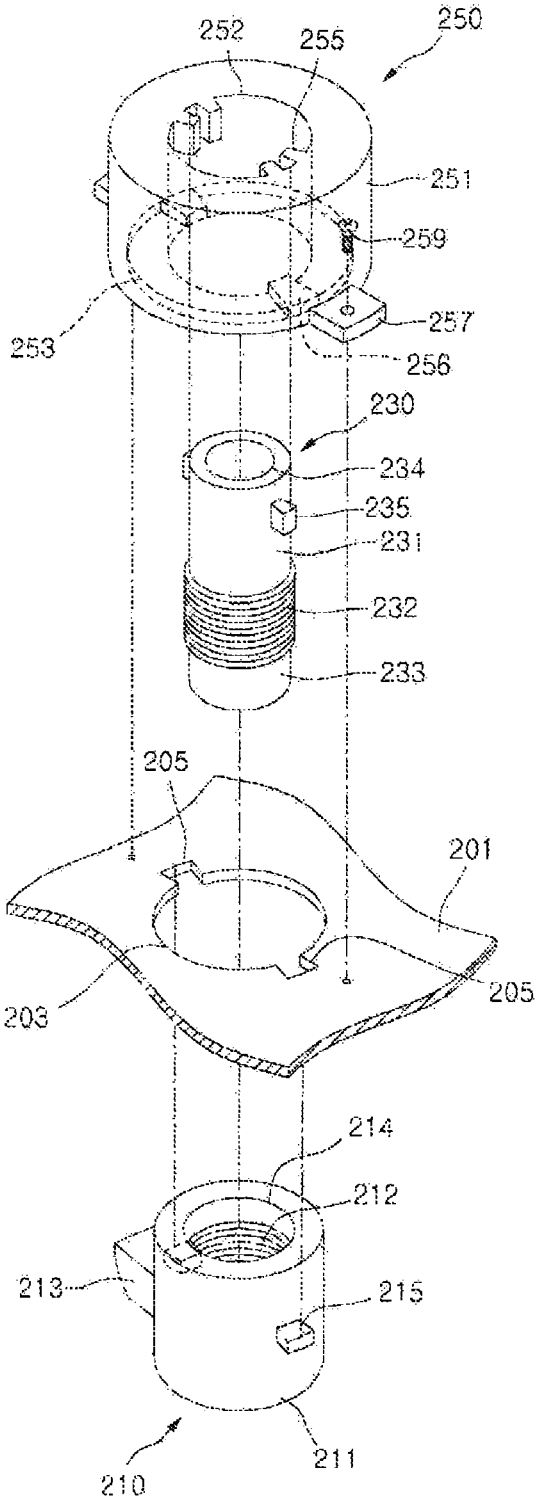
FIG. 2 is an exploded perspective view showing how a rotating lever in FIG. 1 is coupled to a dispenser.
Figure 3:
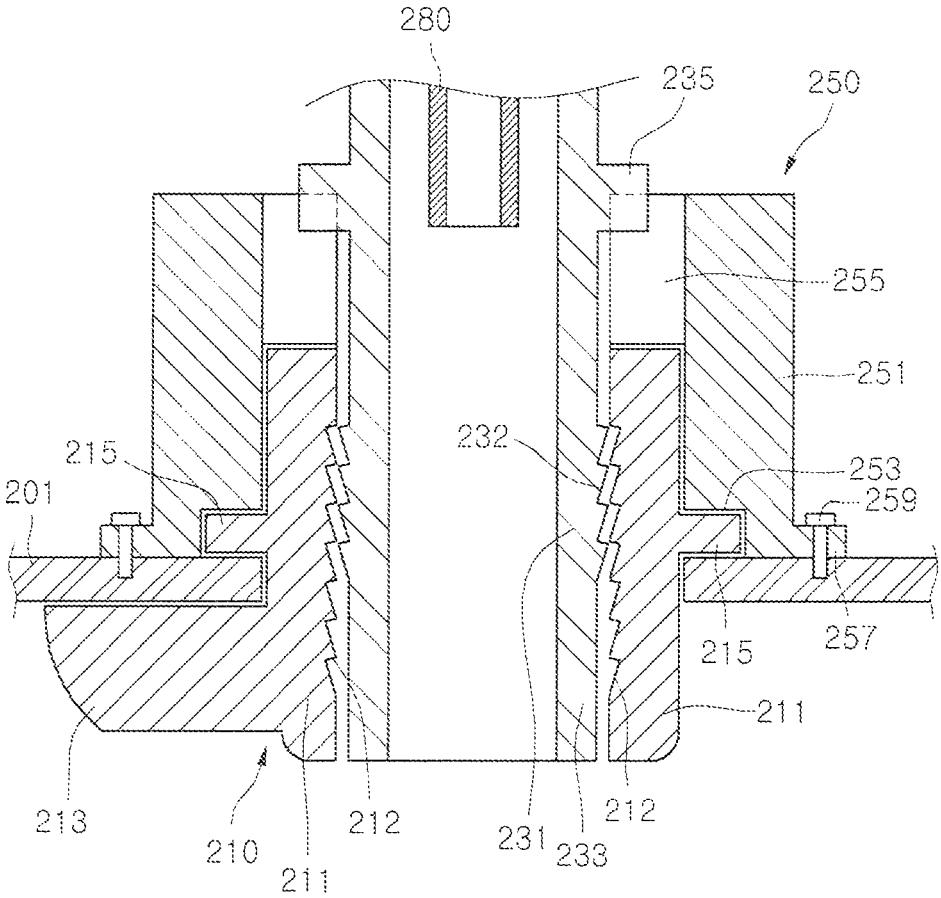
FIG. 3 is a side sectional view showing the rotating lever in FIG. 1 before it is rotated.
Figure 4:
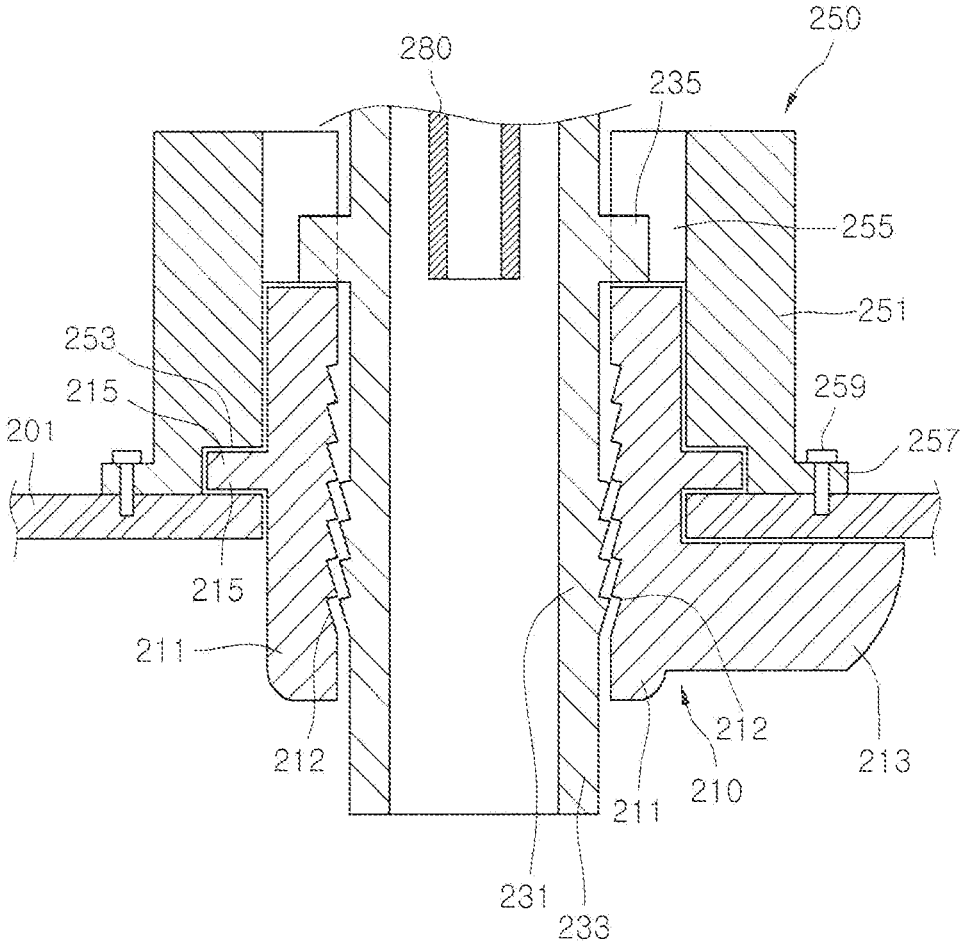
FIG. 4 is a side sectional view showing the rotating lever in FIG. 1 after it is rotated.

FIG. 2 is an exploded perspective view showing how a rotating lever in FIG. 1 is coupled to a dispenser, FIG. 3 is a side sectional view showing the rotating lever in FIG. 1 before it is rotated, and FIG. 4 is a side sectional view showing the rotating lever in FIG. 1 after it is rotated.

Referring to FIGS. 1 to 4, the rotating lever 210 is formed in a cylindrical shape extending vertically, and defines a hole in which a safety tap 230 (to be described) is inserted.

Specifically, the rotating lever 210 includes a lever body 211 of a cylindrical shape, a handle 213 formed projecting sideways from the outer surface of the lever body 211, and a seating portion 215 formed above the handle 213 at a predetermined distance apart from the handle 213.

A tap insert hole 214 is defined vertically through the center of the lever body 211, into which the safety tap 230 is inserted. Here, the diameter of the tap insert hole 214 is made to correspond to the outer diameter of the safety tap 230. Also, female screw threads 212 are defined in the inner periphery of the lever body 211 defining the tap insert hole 214. The female screw threads 212 are defined to correspond to the moving length of the safety tap 230.

The handle 213 is formed at the bottom of the rotating lever 210 to be exposed in the vessel receiving niche 207 and project a predetermined length from the outer surface of the lever body 211 to enable a user to easily turn the rotating lever 210 with his/her fingers, etc. Moreover, the handle 213 may be oriented to the left or right side of the dispenser 20 after the rotating lever 210 is coupled to the housing 201. In present embodiments, the handle 213 is exemplarily described as oriented toward the left of the dispenser 20 after the rotating lever 210 is coupled to the housing 201.

Also, the seating portion 215 is formed separated from the top of the handle 213 by a length corresponding to the thickness of the housing 201. Accordingly, when the rotating lever 210 is coupled to the housing 201, the housing 201 is inserted between the handle 213 and the seating portion 215. The seating portion 215 guides the rotating lever 210 to couple to the housing 201 at a precise location, and is seated on the upper surface of the housing 201 when the rotating lever 210 is rotated by a predetermined angle after the seating portion 215 is inserted in the housing 201. Also, the seating portion 215 may be formed in duplicate at the same height and mutually facing each other.

A lever insert hole 203 is defined through the top surface of the housing 201, into which the rotating lever 210 is inserted. The lever insert hole 203 is defined in a size corresponding to the outer diameter of the lever body 211.

Also, a seating portion insert hole 205, through which the seating portion 215 passes, is defined at a side of the lever insert hole 203. The seating portion insert hole 205 is defined corresponding to the shape and position of the seating portion 215. By inserting the seating portion 215 in the seating portion insert hole 205, a technician can mount the rotating lever 210 at a precise position.

Here, after the technician inserts the rotating lever 210 bottom first into the lever insert hole 203, it is rotated counterclockwise by a predetermined angle. Thus, the seating portion 215 can be seated on the upper surface of the housing 201. Also, the distance between the seating portion 215 and the handle 213 is made to correspond to the thickness of the housing 201, so that the rotating lever 210 can be securely coupled to the housing 201.

After the rotating lever 210 is coupled to the housing 201, the safety tap 230 is inserted in the tap insert hole 214. The safety tap 230 is a component for preventing hot water from splashing to the outside of a vessel when the hot water button 206*a* is selected. The function of the safety tap 230 will be described in detail below.

The safety tap 230 includes a cylindrical tap body 231, male screw threads 232 defined in the outer periphery of the tap body 231, a projecting portion 233 defining the bottom of the tap body 231 and externally exposed when the safety tap 230 is withdrawn, and a supporting rib 235 for supporting and preventing the tap body 231 from rotating.

In detail, the tap body 231 is cylindrical and extends vertically, and, has an exterior formed to correspond to the diameter of the tap insert hole 214. Also, an outlet insert hole 234, in which a water outlet 280 connected to a water storage tank (not shown) provided inside the body 110, is defined vertically through the center of the tap body 231. Thus, the tap body 231 is formed of a sufficient length so that its bottom can be positioned to correspond to the bottom of the rotating lever 210 and its top can be positioned to correspond to the top of a lever cover 250 (to be described).

Additionally, the male screw threads 232 are formed to correspond to the female screw threads 212, so that by inserting the male screw threads 232 in the female screw threads 212, the safety tap 230 is fixed to the rotating lever 210. Further, the male screw threads 232 are defined up to a point separated a predetermined distance from the bottom of the tap body 231, so that even when the safety tap 230 is moved downward, the screw threads are not exposed outside the dispenser 20.

Also, the projecting portion 233 defines the portion extending from the point at which the male screw threads 232 are terminated to the bottom of the tap body 231.

The supporting rib 235 is formed in a predetermined shape projecting from the upper end of the tap body 231. Here, the supporting rib 235 is formed so that its projecting end does not project further outward than the outer periphery of the lever body 211. Also, the supporting rib 235 may be formed to be separated from the top of the lever body 211 by the moving distance of the safety tap 230 when the safety tap 230 is coupled to the rotating lever 210. That is, when the safety tap 230 moves downward, the supporting rib 235 may be formed to catch on the top of the lever body 211.

After the safety tap 230 is coupled to the rotating lever 210, the lever cover 250 is made to cover it so that the safety tap 230 is fixed to be unable to rotate.

In detail, the lever cover 250 includes a cylindrical cover body 251, a guide hole 252 defined in the center of the cover body 251 in which the rotating lever 210 and the safety tap 230 are inserted, a retaining portion 255 formed to project from an inner periphery of the cover body 251 defined by the guide hole 252 to retain the supporting rib 235, a seating portion receptacle 253 recessed upward into the cover body 251 from the undersurface thereof, and an impeding projection 256 formed to project from the seating portion receptacle 253 to a position corresponding to the seating portion insert hole 205. Also, a coupling portion 257 is formed projecting from either side of the lower end of the cover body 251 to be coupled with a bolt 259 to the housing 201. Accordingly, the cover body 251 can be maintained in a state firmly coupled to the housing 201.

The diameter of the guide hole 252 is made to correspond to the external dimensions of the lever body 211, and the guide hole 252 is defined vertically through the cover body 251. The lever body 211 that projects above the housing 201 is inserted into the guide hole 252. Here, the seating portion receptacle 253 is defined at the bottom of the cover body 251 so that the cover body 251 can be coupled to the housing 201 without being impeded by the seating portion 215.

Furthermore, the retaining portion 255 is formed to project from the inner circumference of the cover body 251 above the guide hole 252. The retaining portion 255 is formed to enclose either side of the supporting rib 235, and has at least a portion thereof disposed within the rotating radius of the supporting rib 235. Also, the retaining portion 255 extends vertically in a length corresponding to the moving distance of the safety tap 230. Thus, the supporting rib 235 is retained by the retaining portion 255 to not rotate but move only vertically.

The impeding projection 256 is a component for restricting the rotating angle of the rotating lever 210, and is formed in the seating portion receptacle 253 corresponding in position to the seating portion insert hole 205. That is, after the rotating lever 210 is coupled to the housing 201, and the lever cover 250 is mounted to the housing 201, the seating portion insert hole 205 is closed by the impeding projection 256, so that the rotating lever 210 can be rotated only to the point where the seating portion 215 is impeded by the impeding projection 256.

Provided below is a description of the assembly process and operation of the dispenser 20 for a refrigerator 100 according to the first embodiment of the present invention configured as above.

First, the rotating lever 210 is inserted upward from below into the housing 201 to pass the seating portion 215 through the seating portion insert hole 205. Here, after the rotating lever 210 is inserted until the handle 213 is impeded by the housing 201, the rotating lever 210 is rotated counterclockwise to enable the handle 213 to face the left side of the dispenser 20. Accordingly, the seating portion 215 can be seated apart from the top of the seating portion insert hole 205 on the top surface of the housing 201.

Then, the safety tap 230 is inserted from its top end into the tap insert hole 214. Next, the safety tap 230 is rotated by a predetermined angle to couple the male screw threads 232 and the female screw threads 212. Thus, the safety tap 230 is fixed to the rotating lever 210. Here, the supporting rib 235 is positioned to be capable of insertion in the retaining portion 255.

After the safety tap 230 is coupled to the rotating lever 210, the lever cover 250 is coupled with a bolt 259 to the housing 201. Here, when the rotating lever 210 is inserted in the guide hole 252, the supporting rib 235 is inserted in the retaining portion 255. That is, the outer periphery of the lever body 211 can be fitted tightly in the guide hole 252. Also, the impeding projection 256 prevents rotation of the seating portion 215 by being disposed in-line with the seating portion insert hole 205.

When the rotating lever 210, the safety tap 230, and the lever cover 250 are coupled through the above process, the handle 213 is disposed directly left of the dispenser 20, the lower portion of the safety tap 230 is disposed corresponding to the lower portion of the rotating lever 210, and the projecting portion 233 is disposed inside the lever body 211. Also, the handle 213 is disposed in the upper portion of the vessel receiving niche 207 to enable a user to easily manipulate the rotating lever 210.

A description on the operation of the rotating lever 210 and the safety tap 230 will be provided below.

The safety tap 230 is withdrawn to and inserted from a predetermined length below the lever body 211 in accordance with manipulation of the rotating lever 210. Specifically, when a user wants to dispense hot water from the dispenser 20, the rotating lever 210 is rotated to move the safety tap 230 downward and expose the projecting portion 233.

In detail, when the user wants to dispense hot water, the hot water button **206*a* is pressed to select hot water mode. Here, water is heated by a heater (not shown) provided within the body 110, and is dispensed through the water outlet 280. Because the hot water heated by the heater is extremely hot, splashing water due to improper handling by a user or dropping water can become a safety hazard. To obviate this problem, a user rotates the rotating lever 210 to withdraw the safety tap 230**.

A user rotates the handle 213 by approximately 180°. Because the rotating lever 210 has the seating portion 215 mounted and supported on the housing 201, the handle can be turned horizontally. Here, the rotating lever 213 is rotated until it is impeded by the impeding projection 256.

Also, because the safety tap 230 is connected to the rotating lever 210 through coupling of the male screw threads 232 and the female screw threads 212, when the rotating lever 210 is rotated, the safety tap 230 is also rotated. Here, because the supporting rib 235 is inserted in the retaining portion 255, the safety tap 230 can be moved upward and downward. That is, when the rotating lever 210 is rotated, the male screw threads 232 move upward and downward along the female screw threads 212.

When a user rotates the handle 213 forward as described above, the safety tap 230 is moved downward, and the projecting portion 233 is withdrawn downward of the rotating lever 210.

When the projecting portion 233 is withdrawn downward, hot water can be dispensed from a lower position. That is, when the projecting portion 233 is withdrawn downward, the point from which water is dispensed can either be brought closer to the opening of a vessel to be filled with water, or can be disposed within the vessel. Therefore, because the above safety problem is not manifested, a user can assuredly use the dispenser.

When dispensing cold water, the handle 213 may be rotated in the opposite direction to insert the safety tap 230 into the rotating lever 210.

A description of a refrigerator and a control method thereof according to the second embodiment of the present invention will, be provided below with reference to the drawings.

Because the differences between the second and first embodiments lie in the safety tap withdrawing configuration, the description of the second embodiment will be centered around the differences, and like reference numerals used in the first embodiment will be used for like elements.

Figure 5:
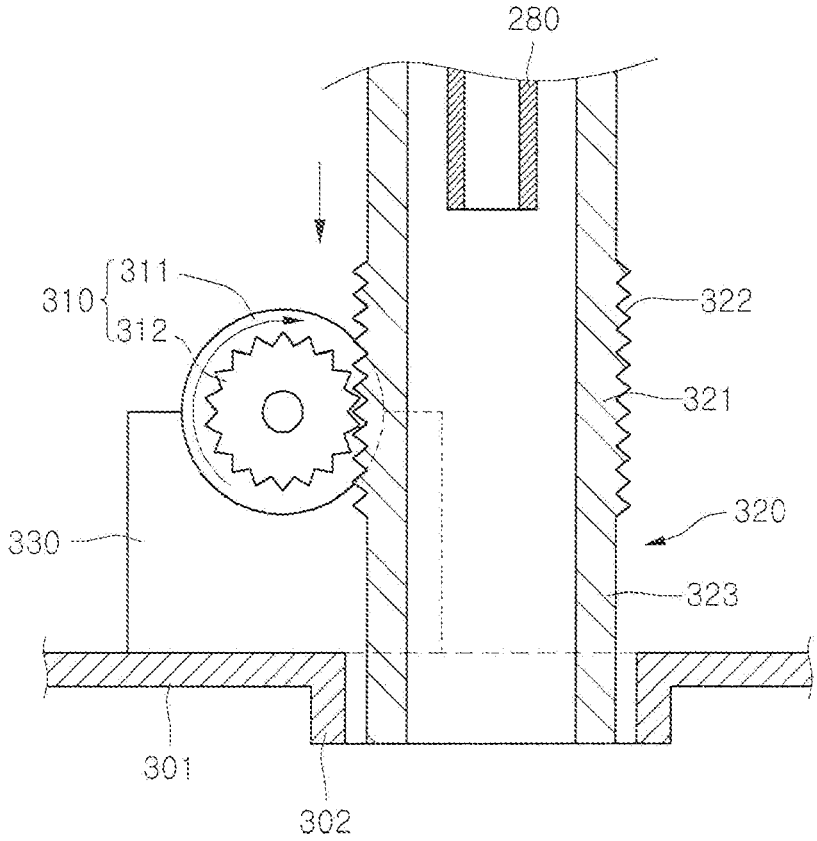
FIG. 5 is a side sectional view showing the inside of a dispenser of a refrigerator according to a second embodiment of the present invention.
Figure 6:
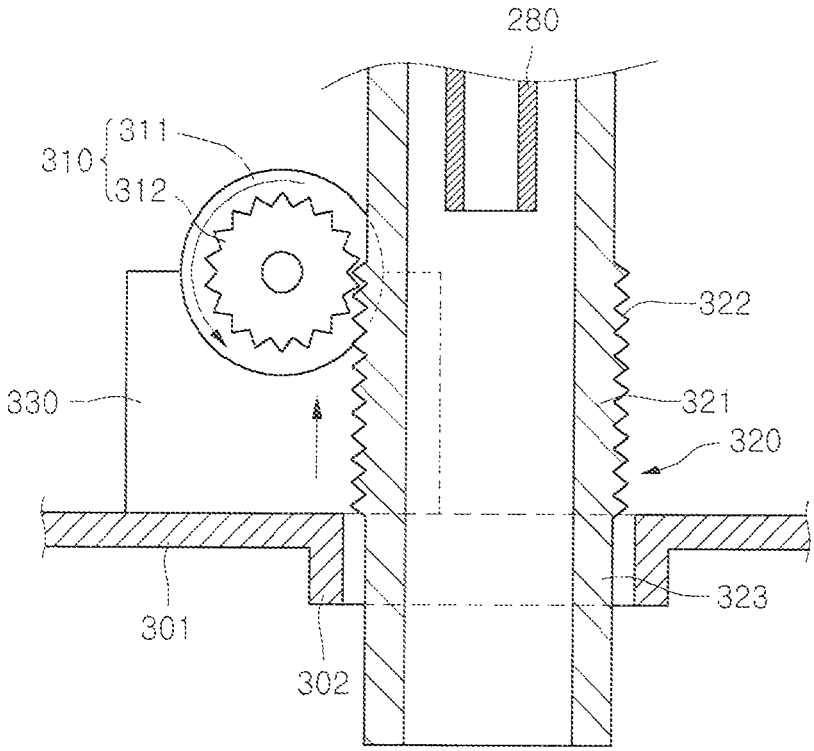
FIG. 6 is a side sectional view showing a safety tap in FIG. 5 in a withdrawn state.
Figure 7:
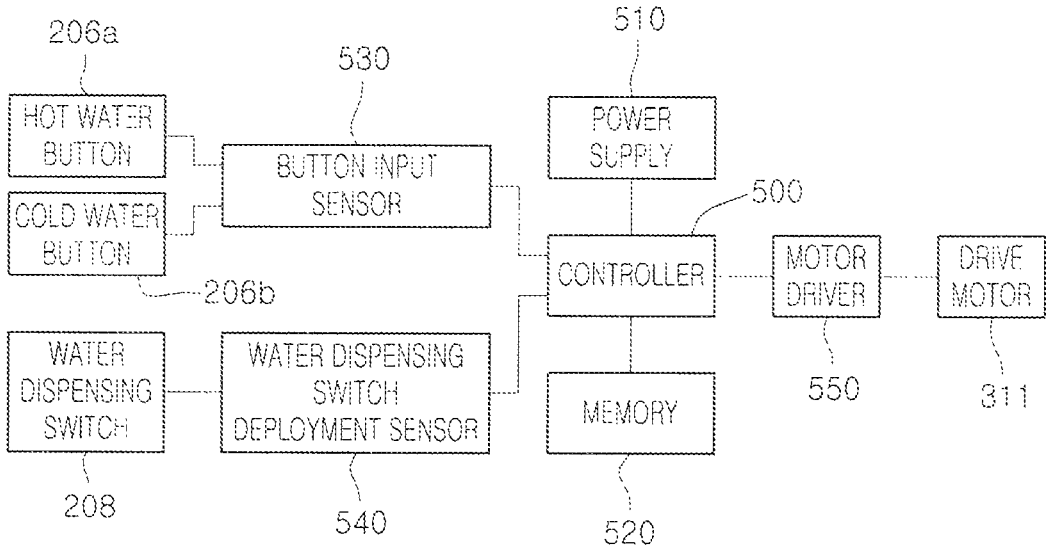
FIG. 7 is a control block diagram of a refrigerator according to the second embodiment of the present invention.

FIG. 5 is a side sectional view showing the inside of a dispenser of a refrigerator according to a second embodiment of the present invention, FIG. 6 is a side sectional view showing a safety tap in FIG. 5 in a withdrawn state, and FIG. 7 is a control block diagram of a refrigerator according to the second embodiment of the present invention.

Referring to FIGS. 5 to 7, a dispensing portion 302 is formed on a dispenser housing 301 to indicate the region from where water is dispensed.

The dispensing portion 302 is formed on the housing 301, and projects a predetermined distance from the housing 301 to indicate to a user from which area water is dispensed. Also, a hole is formed through the inside of the dispensing portion 302, for a safety tap 320 to be passed through. The diameter of the hole is made to correspond to the outer diameter of the safety tap 320. Accordingly, the safety tap 320 can be inserted and supported in the dispensing portion 302.

As a component for providing safety to users when dispensing hot water, the safety tap 320 includes a cylindrical tap body 321, a rack 322 formed on the outer periphery of the tap body 321, and a projecting portion 323 defining the lower part of the tap body 321 to be externally exposed when the safety tap 320 is withdrawn.

In detail, the tap body 321 is formed in a vertically extending cylindrical shape, and has an outer periphery corresponding to the diameter of the hole defined in the dispensing portion 302. Also, a hole, in which the water outlet 280 is inserted, is defined vertically through the center of the tap body 321. Moreover, the tap body 321 may be formed of a sufficient length to enable its bottom to correspond in position to the dispensing portion 302 when it is withdrawn.

Also, the rack 322 is formed at the approximate center of the tap body 321, and extends vertically to enable vertical movement of the safety tap 320. The rack is formed of a length corresponding to the moving length of the safety tap 320.

A driver 310 for moving the safety tap 320, and a driver supporting portion 330 for supporting the driver 310 are provided above the housing 301.

The driver 310 includes a drive motor 311 and a pinion 312 connected to and rotated by the drive motor 311. The drive motor 311 is mounted on the driver supporting portion 330 and fixed to the housing 301.

The drive motor 311 is provided at a position at which the pinion 312 can engage and move in connection with the rack 322, and rotates the pinion 312 in both directions to move the safety tap 320 upwards and downwards.

The safety tap 320 configured as above moves upward and downward to enable users to safely dispense hot water.

A controller 500 is included in the refrigerator 100 to control the components thereof. The controller 500 includes a power supply 510 that supplies power to each component, a memory 520 for storing data required to operate the refrigerator 100, a button input sensor 530 that senses the selection of the hot water button 206*a* and the cold water button 206*b*, a water dispensing switch deployment sensor 540 for sensing whether the water dispensing switch 208 is deployed, and a motor driver 550 for controlling the operation of the drive motor 311.

The button input sensor 530 is connected to the hot water button 206*a* and the cold water button 206*b*, and transmits corresponding electrical signals to the controller 500 when a user selects the hot water button 206*a* or the cold water button 206*b*. Also, the water dispensing switch deployment sensor 540 transmits an electrical signal to the controller 500 according to whether a user presses the water dispensing switch 208.

The controller 500 controls the motor driver 550 according to signals transmitted from the button input sensor 530 and the water dispensing switch deployment sensor 540. The motor driver 550 is connected to the drive motor 311 to rotate the drive motor 311 in either direction according to the controlling by the controller 500.

The operation of a refrigerator configured as above according to the second embodiment of the present invention will be described below.

When a user selects the hot water button 206*a*, the button input sensor 530 transmits a signal to the controller 500. Here, the controller 500 may control a heater (not shown) to prepare hot water to be dispensed.

Then, when the user presses the water dispensing switch 208 with a vessel, etc., the water dispensing switch deployment sensor 540 transmits a signal to the controller 500 that the water dispensing switch 208 is turned ON. When the controller 500 receives the ON signal for the water dispensing switch 208, it transmits a signal to the motor driver 550 to operate and rotate the drive motor 311 in one direction. In the present embodiment, the drive motor 311 is operated to rotate the pinion 312 clockwise. Due to the engagement of the rack 322 and pinion 312, the safety tap 320 is withdrawn by a predetermined length through the dispensing portion 302 out from the housing 301. That is, the projecting portion 323 is more closely disposed to the opening of the vessel, thus enabling a user to obtain hot water safely without worrying about sustaining burns.

Then, when the user releases the vessel from the water dispensing switch 208, the water dispensing switch deployment sensor 540 transmits a signal to the controller 500 that the water dispensing switch 208 has been turned OFF. When the controller 500 receives the signal that the water dispensing switch 208 has been turned OFF, it transmits a signal to the motor driver 550 to operate and rotate the drive motor 311 in the opposite direction. In the present embodiment, the pinion 312 is rotated counterclockwise. Accordingly, the safety tap 320 is raised to be inserted back into the dispensing portion 302.

Figure 8:
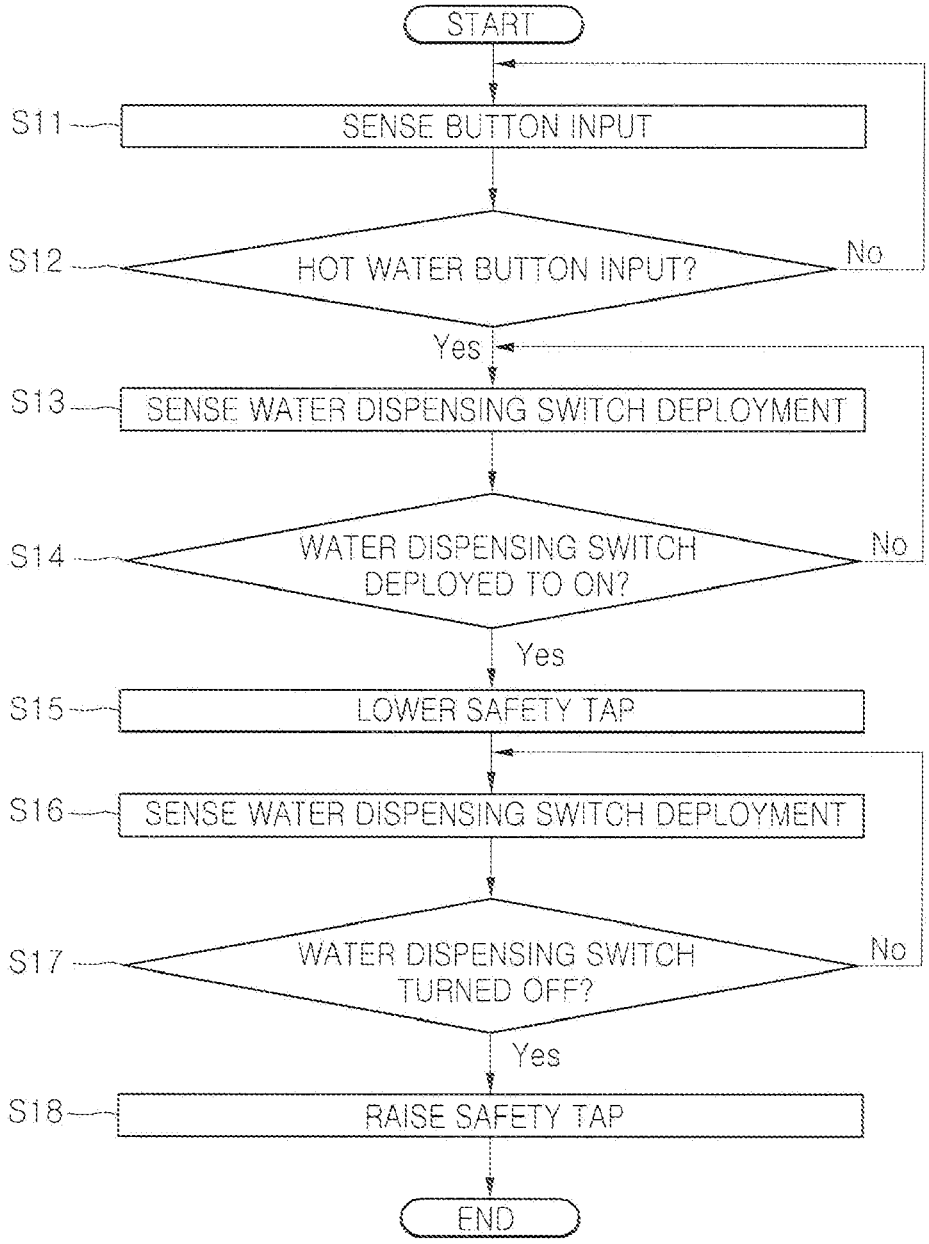
FIG. 8 is a flowchart showing a control method for a refrigerator according to the second embodiment of the present invention.

FIG. 8 is a flowchart showing a control method for a refrigerator according to the second embodiment of the present invention.

Referring to FIG. 8, the button input sensor 530 senses in operation S11 an input made through the control buttons 204 and the hot water button 206*a* and the cold water button 206*b*. The button input sensor 530 is controlled to be continuously on standby, in order to generate different signals according to the types of buttons selected and transmit the signals to the controller 500.

Here, the controller 500 determines in operation S12 whether the signal transmitted from the button input sensor 530 is a signal corresponding to the hot water button 206*a*. If the signal is not the hot water button 206*a* signal, the standby state is resumed to await another button input.

When the signal transmitted from the button input sensor 530 is determined to be the signal corresponding to the hot water button 206*a*, the controller 500 may perform the function of controlling a heater (not shown) to heat water, etc. Also, whether the water dispensing switch 208 has been deployed is sensed through the water dispensing switch deployment sensor 540, and a signal is transmitted to the controller 500 in operation S13.

Here, when an ON signal is determined to have been sent from the water dispensing switch deployment sensor 540 in operation S14, the controller 500 controls the motor driver 550 to lower the safety tap 320 in operation S15. Accordingly, the projecting portion 323 is withdrawn below the dispensing portion 302 to be closer to the opening of the vessel, from which point hot water can be dispensed.

Then, the water dispensing switch deployment sensor 540 continues to monitor whether the water dispensing switch 208 is deployed, and transmits a signal in operation S16 to the controller 500.

When an OFF signal is received in operation S17 from the water dispensing switch deployment sensor 540, the controller 500 determines that dispensing of hot water has been completed, and controls the motor driver 550 to raise the safety tap 320 in operation S18. Accordingly, the projecting portion 323 is inserted back into the dispensing portion 302.

When dispensing hot water with the above-described control method, a user can safely use a dispenser.

Also, as another embodiment of a control method for a refrigerator according to the second embodiment of the present invention, the safety tap 320 may be selectively operated by the selection of the hot water button 206*a* or the cold water button 206*b*. That is, when the hot water button 206*a* is selected and the button input sensor 530 transmits a signal to the controller 500, the controller 500 may activate the motor driver 550 to lower the safety tap 320. Therefore, after a user presses the hot water button 206*a*, the user can safely dispense hot water at any time by deploying the water dispensing switch 208.

When the cold water button 206*b* is selected, the button input sensor 530 may transmit a signal to the controller 500, and the safety tap 320 may be raised.

The spirit and scope of the present invention are not limited to the embodiments provided herein, and various modifications, additions, and deletions may be made to embodiments to fall within the spirit and scope of the present invention.

What is claimed is:

1. A refrigerator comprising:

a body having a door; and a liquid dispensing unit located in the door, the liquid dispensing unit including:

a housing located in the door;

a displaceable tap located at the housing, the displaceable tap being linearly moveable upwardly and downwardly, the displaceable tap being configured to dispense liquid therethrough; and a rotatable mechanism connected to the displaceable tap to move the displaceable tap upwardly and downwardly, the rotatable mechanism including a rotating lever that is rotatable about a vertical axis, the rotating lever having a first threaded portion, wherein the displaceable tap includes a second threaded portion, the second threaded portion being engaged with the first threaded portion such that rotation of the rotating lever moves the displaceable tap in the vertical direction.

2. The refrigerator of claim 1, wherein the rotating lever includes:

a substantially cylindrical lever body having a vertical bore extending therethrough, the first threaded portion being formed on at least a portion of the vertical bore of the lever body; and a handle extending from the lever body, the handle being graspable by a user and rotatable about the vertical axis.

3. The refrigerator of claim 2, wherein the displaceable tap includes a vertical bore extending therethrough, the second threaded portion being formed on at least a portion of an outer surface of the displaceable tap.

4. The refrigerator of claim 3, wherein the liquid dispensing unit includes a nozzle configured to dispense liquid therethrough, the nozzle being received in the vertical bore of the displaceable tap.

5. The refrigerator of claim 2, wherein the rotating lever includes at least one seating portion formed on the lever body above the handle, and wherein the housing includes a wall having a hole for receiving the lever body, the wall being held between the at least one seating portion and the handle.

6. The refrigerator of claim 5, wherein the liquid dispensing unit includes a lever cover connected to an upper surface of the wall, the handle being located at a lower surface of the wall.

7. The refrigerator of claim 6, wherein the lever cover includes a guide hole extending therethrough, an upper portion of the displaceable tap being received in the lever cover.

8. The refrigerator of claim 7, wherein the lever cover includes at least one retaining portion formed in the guide hole, and the upper portion of the displaceable tap includes at least one support rib that cooperates with the at least one retaining portion to prevent the displaceable tap from rotating.

9. The refrigerator of claim 1, wherein the displaceable tap includes a projecting portion that extends below the second threaded portion, the projecting portion being extendable beyond the rotating lever when the displaceable tap is lowered, and the projecting portion being covered by the rotating lever when the displaceable tap is raised.

10. The refrigerator of claim 1, wherein the liquid dispensing unit includes a nozzle configured to dispense liquid therethrough.

11. The refrigerator of claim 1, wherein the displaceable tap moves vertically upwardly and downwardly.

* * * * *